United States Patent [19]

Lombard

[11] Patent Number: 4,598,502

[45] Date of Patent: Jul. 8, 1986

[54] METHOD AND APPARATUS FOR SURFACING OPTICAL LENSES

[75] Inventor: Gérard Lombard, Velaines, France

[73] Assignee: Essilor International Cie Generale d'Optique, Creteil, France

[21] Appl. No.: 643,374

[22] Filed: Aug. 23, 1984

[30] Foreign Application Priority Data

Sep. 2, 1983 [FR] France ..... 8314109

[51] Int. Cl.[4] ..... B24B 1/00; B24B 13/00

[52] U.S. Cl. ..... 51/284 R; 51/234; 51/216 LP; 51/124 L; 51/131.2

[58] Field of Search ..... 51/284 R, 284 E, 277, 51/234, 216 R, 216 LP, 237 R, 55, 131.2, 235, 124 L, 238 GG, 238 S, 317, 292, 281 R; 384/109

[56] References Cited

U.S. PATENT DOCUMENTS 3,210,894 10/1965 Bentley et al. ..... 51/284
3,589,071 6/1971 Hirschhorn ..... 51/317 X
3,889,426 6/1975 Blum ..... 51/55
4,373,991 2/1983 Banks ..... 51/281 R X

FOREIGN PATENT DOCUMENTS 1041832 10/1958 Fed. Rep. of Germany .
3027445 10/1982 Fed. Rep. of Germany .
1266921 6/1961 France .

*Primary Examiner*—Frederick R. Schmidt
*Assistant Examiner*—Debra S. Meislin
*Attorney, Agent, or Firm*—Charles E. Brown; Charles A. Brown

[57] ABSTRACT

A lens holder device is employed having a bell-shaped chamber, at least a portion of the sidewall of the chamber at an open end thereof having a circular section and adapted to accommodate with radial clearance a lens to be surfaced. A conduit communicates with the chamber and supplies pressurized hydraulic fluid into the chamber. The pressurized hydraulic fluid in the chamber forms a hydraulic cushion for the lens, and a hydraulic film flowing between the peripheral edge of the lens and the sidewall portion, the hydraulic film flowing out of the open end of the chamber.

13 Claims, 3 Drawing Figures

METHOD AND APPARATUS FOR SURFACING OPTICAL LENSES

BACKGROUND OF THE INVENTION

The present invention relates generally to the surfacing of optical lenses, and more particularly though not exclusively, to optical lenses having a ratio of thickness to diameter which is relatively large.

Such is the case with lenses employed individually or in groups for optical instruments, whether these lenses are biconvex, biconcave or concavo-convex.

As is known the front and rear faces of such optical lenses are usually spherical.

Also, the surfacing of the faces must be carried out with high precision.

Such surfacing which comprises in succession rough lapping, fine lapping and polishing is usually carried out by securing optical lens in general in groups, to a lens or workpiece holder which also functions to urge the lenses in succession against a suitable rotatable surfacing tool.

Up to now optical lenses to be surfaced have been commonly affixed relatively rigidly to such a lens holder by means of tar or other bonding substance of this type.

Also, up to the present day the fabrication of an optical lens of this type which not only involves surfacing both faces thereof but also trimming the edge to the desired diameter for accommodation in the optical instrument, generally comprises the following steps: first, rough lapping the faces of the lens one after the other, fine lapping and polishing one of the faces of the lens, fine lapping and polishing the other face of the lens, and finally trimming the edge of the lens to the desired diameter.

For each fine lapping and polishing step, in particular, it is necessary to center the lens on the lens holder and then to fix the lens in place thereon. Consequently the known surfacing procudure for such an optical lens requires handling the lens many times.

Further, painstaking care is required for obtaining the required precision.

Therefore the operator must be a skilled technician and the cost of surfacing is therefore relatively high.

Moreover, it is not uncommon, despite the care with which the various surfacing steps are carried out, that the resulting optical lenses have discrete prism defects, whereby a light ray passing through the prism has a deviation greater than it would have had, if both faces were perfectly spherical.

The reason for such a drawback may lie in the fact that because of the relatively rigid securement of the lens on the lens holder during surfacing the lens applied against the surfacing tool has no freedom of movement with respect to the lens holder and therefore may be locally pinched between the lens holder and the surfacing tool.

OBJECT AND SUMMARY OF THE INVENTION

A general object of the present invention is an apparatus which mitigates against such a drawback in a very simple manner.

According to a method for surfacing an optical lens there is provided a lens holder having a bell-shaped chamber for a lens to be surfaced and a rotatable surfacing tool. A suitably sized lens to be surfaced is introduced into the chamber such that there remains potential radial clearance between the peripheral edge of the lens and an adjacent portion of the sidewall of the chamber. The lens in the lens holder device is brought into position relative to the surfacing tool. Pressurized hydraulic fluid is supplied into the chamber so as to form a hydraulic cushion on the face of the lens remote from the surfacing tool to apply the lens against the surfacing tool and to form a hydraulic film between the peripheral edge of the lens and the adjacent portion of the chamber sidewall.

According to another aspect of the invention there is provided a lens holder device for surfacing a lens with a surfacing tool. The lens holder device comprises a bell-shaped chamber, at least a portion of the sidewall of the chamber at an open end thereof having a circular section and adapted to accommodate with radial clearance a lens to be surfaced. A conduit communicates with the chamber for supplying pressurized hydraulic fluid into the chamber. Pressurized hydraulic fluid in the chamber forms a hydraulic cushion for the lens and a hydraulic film flowing between the peripheral edge of the lens and the sidewall portion.

According to the present invention during surfacing the lens is subjected to the hydraulic pressure which urges the lens against the surfacing tool with the desired force and since the hydraulic cushion is constantly maintained, and the hydraulic film flows continuously along the periphery of the lens whereby the edge of lens is out of direct contact with the corresponding sidewall portion of the lens holder while it remains in position relative to the surfacing tool.

Numerous advantages follow. First of all, the lens is held in the lens holder without any centering or securement thereon, and the loading of the lens in the lens holder is particularly easy simply, and fast to carry out even for an unskilled operator.

Further, owing to the pressure applying the lens against the surfacing tool being hydraulic it is uniformly applied along the entire opposite face of the lens. And in the case of optical lenses having a relatively high ratio of thickness to diameter, the pressure may be sufficiently great to counterbalance the overturning moment (also relatively high) which may develop in the course of surfacing.

In practice as the lens is not rigidly affixed to and urged by the lens holder against the surfacing tool but freely mounted relative to the lens holder it has a dual freedom of movement relative to the lens holder.

First, under the frictional driving torque of the surfacing tool in contact with the optical lens, the lens is free to rotate about its axis with respect to the lens holder while the hydraulic fluid bleeds along the periphery of the lens effecting the self-alignment of lens with respect to the lens holder and therefore the surfacing tool too.

Further, the lens can to some degree change its inclination with respect to the lens holder and thereby better adjust itself with respect to the lens holder, while the hydraulic pressure uniformly applied to the entire opposite face of the lens counterbalances, as mentioned above, the overturning moment to which lens is subjected, thereby precluding any nonuniform machining of the lens between its central zone and its peripheral zone.

As an overall consequence of these various features there is a remarkable optimization of the surfacing operation and in particular a reduction or even an elimination of prism defects.

Thus, in addition to the great simplicity of the present invention it permits precision surfacing of the type required for optical lenses used for all kinds of optical instruments. In practice, it is possible, according to the present invention, to surface such optical lenses with tolerances of three to five fringes as measured by interferometer.

To be sure, for the present invention to perform its improved results fully, it is desirable to provide optimum metering of the bleed flow rate of the hydraulic fluid at the periphery of the lens being surfaced, and prior to surfacing the lens should be trimmed with precision. Before such an optical lens is mounted in an optical instrument it would have in any case been trimmed with precision.

According to a further feature of the invention the lens is trimmed before surfacing, and in practice it is trimmed to its desired ultimate diameter before surfacing. Hence there is only a single trimming operation carried out on the lens so that this operation does not result in any additional constraint.

Further, by metering the bleed flow rate of the hydraulic fluid at the periphery of the lens being surfaced all vertical friction between the lens and the sidewall of the chamber may be eliminated.

According to a development of the invention additional advantage of the hydraulic fluid may be taken if desired. For example, to adjust and/or enhance the rotation of the lens about its axis during surfacing, the hydraulic fluid may be circulated in the chamber by means of a helical nozzle running along the inner surface of the chamber. By contact with the rotating motion of hydraulic fluid in the chamber, a corresponding rotation is imparted to the lens.

The hydraulic fluid may entrain a suspension of a polishing agent for polishing the lens.

Thus, after the lens is positioned in the chamber the lens holder is brought into place relative to the surfacing tool, the hydraulic fluid with the polishing agent suspended therein may eliminate the need for a separate external supply of polishing agent, and may circulate the polishing agent without interfering with the centering of the lens to be surfaced and the application of the lens against the surfacing tool.

Finally, the lens holder of the invention may advantageously be fitted on most conventional surfacing machines without substantial modifications thereof.

These and other features and advantages of the invention will be brought out from the description which follows, given by way of example, with reference to the accompanying drawing.

DESCRIPTION OF THE PREFERRED EMBODIMENTS

Figure 1:
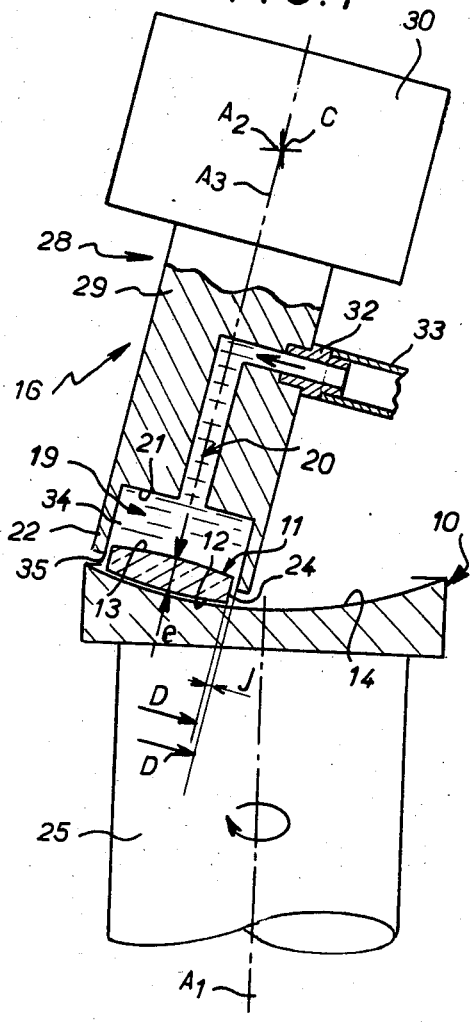
FIG. 1 is a view, partly in section and partly in elevation, of a surfacing machine fitted with the lens holder embodying the invention.

As illustrated in the drawing, there is provided a lens holder for applying an optical lens 11 against a rotatably mounted surfacing tool 10, the lens 11 having a face, for example spherical, which is to be surfaced. The outer contour of the optical lens 11 is typically circular.

The drawing illustrates more particularly the surfacing of optical lenses 11 adapted to equip some kind of optical instrument.

In the FIG. 1 embodiment the optical lens 11 to be surfaced is biconvex, that is, both the front face 12 and the rear face 13 are convex.

As is known the thickness e of such an optical lens at its center is practically always rather large, and therefore so is the ratio of the thickness e to the outer diameter of the lens, the diameter of the optical lens always being relatively small.

The operative or working surface 14 of the surfacing tool 10 for such a biconvex lens is also concave. In practice the working surface 14 is spherical, and the radius of the working surface is equal to that of the face of the lens to be surfaced, here the front face 12.

For rotationally driving the surfacing tool 10, as schematically illustrated in FIG. 1, the surfacing tool 10 may be carried on a shaft 15, which in turn is driven in rotation about its axis A1.

As the associated design features are not part of the present invention, are well known to those skilled in the art and used in conventional surfacing machines they will not be described in detail herein.

As is conventional there is provided a lens or workpiece holder device 16 for applying or holding the optical lens 11 to be surfaced against the surfacing tool 10.

According to a main feature of the invention the lens holder device 16 comprises a bell-shaped chamber 19 for accommodating the optical lens 11 to be surfaced facing the surfacing tool 10, and a conduit 20, described in detail below, adapted to be connected to a source of pressurized hydraulic fluid (not shown).

Generally speaking, the chamber 19 comprises a transverse endwall 21 and an axial sidewall 22 at the periphery of the endwall 21. The sidewall 22 is cylindrical with a circular cross section, at least at its open end, similar to that of the optical lens 11 to be surfaced. In practice, in the illustrated embodiment, the entire sidewall 22 is cylindrical with a circular cross section.

According to a feature of the invention, and for reaons which will be developed below, there is provided by design radial clearance J annularly between the peripheral edge 24 of the optical lens 11 to be surfaced and the sidewall 22 of the chamber 19. In other words the diameter D′ of at least open end of the chamber 19 is slightly greater than the diameter D of the outer periphery of the optical lens 11 to be surfaced.

In practice, the radial clearance J which is deliberately exaggerated in the drawing for the sake of clarity may advantageously be between 0.5 and 0.1 mm. These values are given by way of example and are not intended to limit the scope of the invention.

Of course, the sidewall 22 of the chamber 19 has a sufficient axial dimension so that the optical lens 11 to be surfaced may be received in the chamber 19, with at least part of the peripheral edge 24 of the lens inside the chamber, without the other face 13 of the lens 11 touching the endwall of the chamber 21.

In the arrangement referred to above where the surfacing tool 10 has a spherical working surface 14, the chamber 19 may, as shown, be formed in the free end of a support member 28 oscillatingly mounted about an axis A2 which is perpendicular to the axis A1 of rotation of the surfacing tool and substantially intersects the center C of the spherical working surface 14 of the surfacing tool.

In FIG. 1 the axis A2 is represented by an "X" which coincides with the center C of the spherical working surface 14 of the surfacing tool 10.

In the illustrated embodiment the support member 28 comprises a support spindle 29 at the free end of which is formed the chamber 19 and a block 30 which carries the support spindle 29 and is mounted for oscillating movement about axis A2.

In practice axis A3 coincides with the axis of the chamber 19, and intersects the center C of the working surface 14 of the surfacing tool 10.

Conduit 20 extends from the central zone of the endwall 21 of the chamber 19 along the axis A3 and then turns transversely where it is connected by a connector 32 to a tube 33 in communication with an associated source of pressurized hydraulic fluid.

For operation the optical lens 11 to be surfaced is received partly inside the chamber 19 of the lens holder device 16 and bears against the working surface 14 of the surfacing tool 10, and the pressurized hydraulic fluid is supplied to the chamber 19 through tube 33 and conduit 20. A hydraulic cushion 34 is thus established between the optical lens 11 to be surfaced and the endwall 21 of the chamber 19 and acts on the opposite face 13 of the optical lens 11. Concurrently there is established at the periphery of the lens 11, between the peripheral edge 24 of the lens 11 and the adjacent portion of the sidewall 22 of the chamber 19, a hydraulic film. The hydraulic film in the chamber 19 bleeding or flowing continuously along the peripheral edge of the optical lens 11. The hydraulic cushion 34 and hydraulic film are maintained by the constantly replenished supply of hydraulic fluid by the source.

It will be noted that the optical lens 11 to be surfaced is thus out of direct contact with the lens holder device 16 whereby the lens may rotate about its own axis.

The rotation of the optical lens 11 in the chamber 19 may simply result from the mere contact of the lens 11 with the surfacing tool 10 owing to the differential driving movement imparted to diametrically opposite edges of the optical lens 11 in an eccentric position with respect to the surfacing tool 10.

Figure 3:
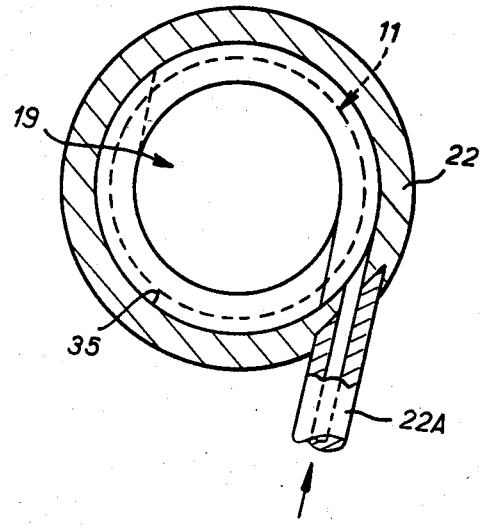
FIG. 3 is a transverse sectional view through a lower part of the chamber and shows means for introducing a rotation effecting fluid into the chamber.

Alternatively the rotation of the lens may be effected or enhanced by pressurized hydraulic fluid introduced obliquely into the chamber 19, or the chamber 19 may be fitted with means adapted to impart a rotating or swirling motion to the hydraulic fluid 22A, as shown in FIG. 3. Such means may, for example, comprise a helical nozzle along the inner surface of the sidewall of the chamber 19.

Alternatively, the rotation of the optical lens 11 may be effected or enhanced by a power means of the usual type provided in conventional surfacing machines.

In any event, oscillation of block 28 and therefore of the lens about axis A2 is in practice insured. Further, rotation of the optical lens may be effected about an axis approximately perpendicular to the working surface 14 of the surfacing tool 10.

The foregoing arrangements which are conventional in surfacing machines need not be described herein in greater detail.

As it will be readily understood the ability of the lens holder device 16 to pivot about axis A2 enables disengagement of the chamber 19 in relation to the surfacing tool 10 which is necessary for the loading or unloading of the optical lens 11 to be surfaced. To this end it is sufficient for the lens holder device 16 to be able to swing far enough to clear the working surface 14 of the surfacing tool 10.

The entire lens holder device 16 may, if desired, be mounted for movement on a support which permits disengagement of the chamber 19 relative to the working surface of the surfacing tool 10.

Figure 2:
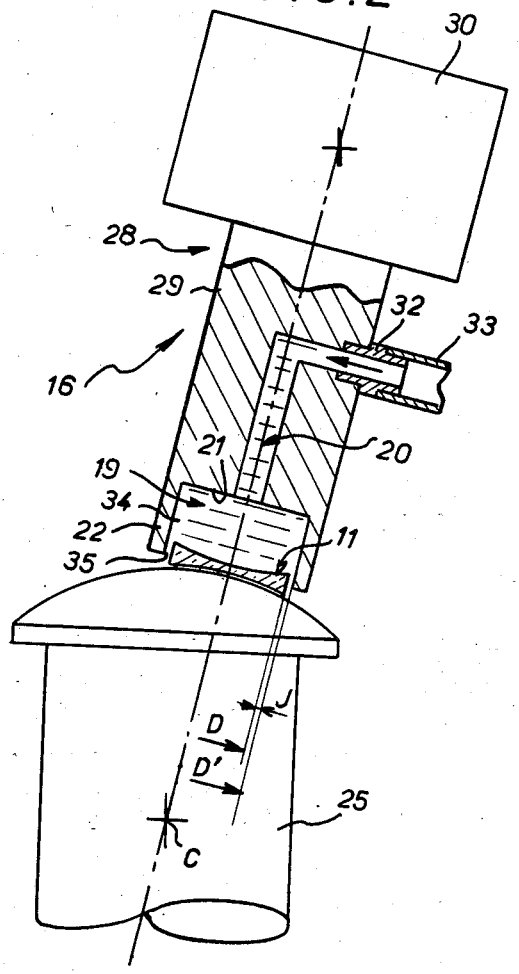
FIG. 2 is a view similar to that of FIG. 1 for an alternative embodiment of the invention, the surfacing tool being illustrated in elevation.

FIG. 2 illustrates an embodiment of the invention for surfacing of an optical lens 11 which is biconcave, that is, the lens has front and rear surfaces 12 and 13 which are both concave, and in practice spherical.

The effective working surface 14 of the surfacing tool 10 is a convex spherical surface. In all other respects this embodiment is identical to the one described above. Concavo-convex optical lenses will obviously require surfacing tools having a convex and a concave working surfaces.

At any rate the hydraulic fluid supplied under pressure to the chamber 19 advantageous entrains in suspension at least one polishing agent. Such a polishing agent may be cerium oxide.

The present invention is of course not intended to be limited to the illustrated and described embodiments but to the contrary encompasses all alternatives and modifications understood to those skilled in the art without departing from the spirit and scope of the invention.

What is claimed is:

1. A method for surfacing an optical lens in which comprising the steps of:

providing a lens holder having a bell-shaped chamber for a lens to be surfaced and a rotatable surfacing tool;

introducing a suitably sized lens to be surfaced into the chamber such that there remains potential radial clearance between the peripheral edge of the lens and an adjacent portion of the sidewall of the chamber;

bringing the lens in the lens holder device into position relative to the surfacing tool;

supplying pressurized hydraulic fluid into the chamber so as to form a hydraulic cushion across the entire face of the lens remote from the surfacing tool, and permitting the hydraulic fluid pressure to escape between the peripheral edge of the lens and the adjacent portion of the chamber sidewall thereby forming a hydraulic film therebetween; and imparting rotational motion to the pressurized fluid in the chamber relative to the axis of the chamber to impart a rotational motion to the lens.

2. The method according to claim 1, comprising centering the lens in the chamber of the lens holder device by the hydraulic film between the peripheral edge of the lens and the adjacent portion of the chamber sidewall.

3. The method according to claim 2, wherein the lens rotates about its axis owing to eccentric positions of the lens relative to the axis of rotation of the surfacing tool in contact with the surfacing tool.

4. The method according to claim 1, comprising rotating the lens about by allowing its axis to take on eccentric positions relative to the axis of rotation of the surfacing tool in contact with the surfacing tool.

5. The method according to claim 1, wherein the lens is trimmed to a desired ultimate diameter before it is introduced into the chamber.

6. The method according to claim 1, wherein the hydraulic fluid contains a suspension of a polishing agent.

7. The method according to claim 1, wherein the hydraulic fluid cushion is in contact with the lens over substantially the entire face of the lens remote from the surfacing tool.

8. A lens holder device for surfacing a lens with a surfacing tool, said lens holder device comprising a bell-shaped chamber, at least a portion of a sidewall of said chamber at an open end thereof having a circular section and adapted to accommodate with radial clearance a lens to be surfaced, a conduit communicating with said chamber adapted to supply pressurized hydraulic fluid into said chamber, a hydraulic cushion for the lens being formed by pressurized hydraulic fluid in said chamber and hydraulic fluid normally flowing between the peripheral edge of the lens and the sidewall portion and out said open end so as to form a hydraulic film between the peripheral edge of the lens and the sidewall portion, said chamber comprising additional means for imparting rotational motion to said pressurized hydraulic fluid introduced into said chamber to impart a rotational motion to the lens.

9. The lens holder device according to claim 8, wherein said additional means for imparting rotational motion to the pressurized fluid comprises a nozzle fixed on the sidewall of said chamber.

10. The lens holder according to claim 8, wherein said hydraulic fluid cushion is in contact with the lens over substantially the entire face of the lens remote from the surfacing tool.

11. Apparatus for surfacing a spherical surface of a lens, said apparatus comprising a rotatable lens surfacing tool having a spherical working surface complementary to that of a desired lens spherical surface and a lens holder device, means mounting said lens holder device for oscillating movement about an axis perpendicular to an axis of rotation of the lens surfacing tool, a center of said spherical working surface substantially intersecting said axis of oscillating movement, lens holder device comprising a bell-shaped chamber, at least a portion of the sidewall of said chamber at an open end thereof having a circular section and adapted to accommodate with radial clearance the lens to be surfaced, a conduit communicating with said chamber adapted to supply pressurized hydraulic fluid into said chamber whereby pressurized hydraulic fluid in said chamber forms a hydraulic cushion for the lens and a hydraulic fluid flows between the peripheral edge of the lens and said sidewall portion to form a hydraulic film between the peripheral edge of the lens and said sidewall portion, said chamber comprising additional means for imparting rotational motion to the pressurized hydraulic fluid introduced into said chamber to impart a rotational motion to the lens.

12. Apparatus according to claim 11, wherein said additional means for imparting rotational motion to the pressurized fluid comprises a nozzle fixed on the sidewall of said chamber.

13. Apparatus according to claim 11, wherein said hydraulic fluid cushion is in contact with the lens over substantially the entire face of the lens remote from the surfacing tool.

* * * * *